US006103976A

United States Patent [19]

Kobayashi et al.

[11] Patent Number: 6,103,976

[45] **Date of Patent: *Aug. 15, 2000**

[54] WIRE AND CABLE FOR USE IN ROBOT

[75] Inventors: Shigeru Kobayashi; Shuzo Suzuoka, both of Kagawa; Ryuji Ninomiya, Saitama; Hidefusa Takahara, Tokyo, all of Japan

[73] Assignee: Yoshinogawa Electric Wire & Cable Co., Ltd., Kagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/019,057

[22] Filed: Feb. 5, 1998

[51] Int. Cl.[7] ..... H01B 11/02

[52] U.S. Cl. ..... 174/113 R; 174/126.2

[58] Field of Search ..... 174/113 R, 113 C, 174/131 A, 126.2

[56] References Cited

U.S. PATENT DOCUMENTS 4,683,349 7/1987 Takebe ..... 174/113 C X

OTHER PUBLICATIONS

Metallurgical Transactions A, vol. 24A, pp. 7–42, Jan. 1993.

T. Takeuchi et al., "Fibrous Chromium and Molybdenum Fabricated by Cold Working Cu–Cr and Cu–Mo Binary Alloys," Journal of the Less–Common Metals, 157 (1990), pp. 25–35 no month.

Y. Sakai et al., "Development of High–Strength, High–Conductivity Cu–Ag Alloys for High–Field Pulsed Magnet Use," Appl. Phys. Lett. 59 (23), (Dec. 2, 1991), pp. 2965–2967.

J. Bevk et al., "Anomalous Increase In Strength of in situ Formed Cu–Nb Multifilamentary Composites," J. Appl. Phys. 49 (12), (Dec. 1978), pp. 6031–6038.

*Primary Examiner*—Kristine Kincaid
*Assistant Examiner*—Chau N. Nguyen
*Attorney, Agent, or Firm*—Baker & Daniels

[57] ABSTRACT

A wire for use in robot including a conductor of metallic fiber-reinforced copper matrix composite whose plastic strain to rupture is substantially less than 0.2%. A plurality of conductors form a twisted wire (2). An insulation member (4) is coated on the twisted wire (2) to form a coated wire (6). The conductivity of the conductor is greater than 70% IACS and the tensile strength of the conductor is greater than 100 Kg/mm$^2$. The metallic fiber-reinforced copper matrix composite is in-situ metallic fiber-reinforced copper matrix composite drawn with a total reduction in sectional area of 99.99% or more.

8 Claims, 3 Drawing Sheets

WIRE AND CABLE FOR USE IN ROBOT

BACKGROUND OF THE INVENTION

1. Field of the Invention

The present invention relates to a wire and cable for use in a robot such as an industrial robot, and particularly to a wire and cable which have both high electrical conductivity and excellent durability.

2. Description of the Related Art

In the industrial robot, an arm thereof moves in a complicated manner and therefore, cables for supplying electric power and transmitting electric signals to a means for processing such as a welding head attached to a distal portion of the arm are frequently bent at a joint of the arm.

In the conventional industrial robot, such a cable is manufactured by using an annealed copper wire. A plurality of annealed copper wires are intertwisted to form a twisted wire, which is coated with coating insulation member to form a coated wire and, a plurality of coated wires are gathered together and covered by a sheath to obtain a movable cable for use in the industrial robot.

In a case where a high durability of the cable is required, a wire made of high durable copper alloy such as Cu alloy containing Sn is used in the cable. The wire made of high durable copper alloy has a durability of five times as large as that of the annealed copper wire.

However, the electrical conductivity and the tensile strengh are generally in a reciprocal relationship and therefore, when a concentration of metal element added to copper is increased, then the conductivity is lowered while the tensile strengh is increased. For example, the pure copper has a conductivity of 100% IACS (International Annealed Copper Standard) which is so high as to be in the second place of that of silver. Whereas tensile strengh of the pure copper is lower than 40 Kg/mm$^2$. On the other hand, a typical beryllium copper alloy for spring has a conductivity of lower than 30% IACS while a tensile strengh of the beryllium copper alloy is greater than 100 Kg/mm$^2$.

In the above-mentioned Cu alloy containing Sn which have been used in trolley wire etc, as Sn concentration increases, then mechanical strengh is improved whereas the conductivity is lowered. For example, the conductivity of the copper alloy containing 0.3% Sn is 70% IACS and, that of the copper alloy containing 0.6% Sn becomes 50 to 60% IACS. In a case where the wire is made of material having lower conductivity, the diameter of the wire, of course, must be increased in order to lower the Joule heat. However, this makes it impossible to meet the requirement that the cable is made thinner and lighter to improve mobility of the arm of the robot.

SUMMARY OF THE INVENTION

An object of the present invention is to provide a wire for use in a robot which has both high electrical conductivity and excellent durability in repeated bending.

Another object of the present invention is to provide a cable for use in the robot which have both high electrical conductivity and excellent durability in repeated bending to improve lifetime of the cable.

Further object of the present invention is to provide a cable for use in the robot which has excellent durability in repeated bending and is thinner and lighter to improve mobility of the arm of the robot.

In order to attain the above objects, according to the present invention, there is provided a wire for use in robot, comprising a conductor of metal fiber-reinforced copper matrix composite whose plastic strain to rupture is substantially less than 0.2%.

In one aspect of the present invention, a plurality of conductors each being made of metal fiber-reinforced copper matrix composite whose plastic strain to rupture is substantially less than 0.2%. Here, an insulation member may be coated thereon to form a coated wire.

In one aspect of the present invention, a conductivity of the conductor is greater than 70% IACS and a tensile strength of the conductor is greater than 100 Kg/mm$^2$.

In one aspect of the present invention, the metal fiber-reinforced copper matrix composite is in-situ metal fiber-reinforced copper matrix composite drawn with a total reduction in sectional area of 99.99% or more.

According to the present invention, there is also provided a cable for use in robot, comprising anyone of the above wires and a sheath covering the wire.

DETAILED DESCRIPTION OF THE INVENTION

Figure 1:
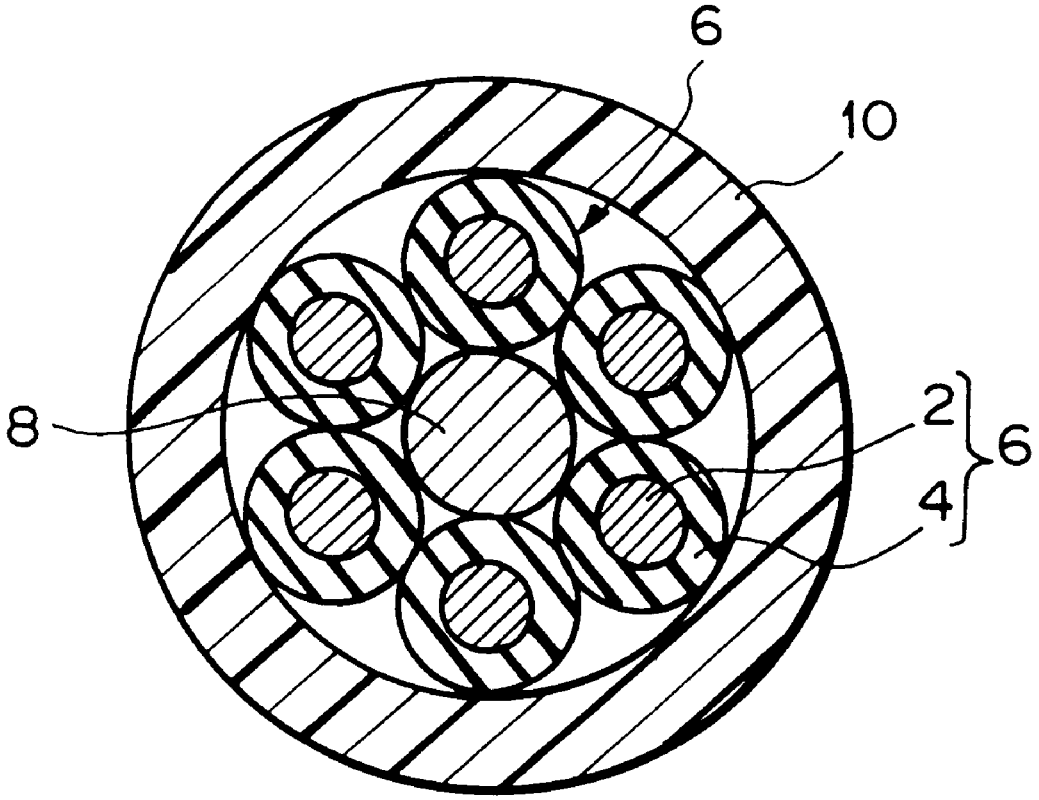
FIG. 1 is a cross-sectional view of a cable for use in robot according to an embodiment of the present invention.

FIG. 1 shows a cross section of a cable according to the present invention. In FIG. 1, reference numeral 2 denotes a twisted wire which comprises a plurality of primary wires. Each primary wire is made of conductor which is metal fiber-reinforced copper matrix composite. Reference numeral 4 denotes a coating insulation member coated on the twisted wire 2 to form a coated wire 6. Reference numeral 8 denotes an insulation core member, around which a plurality of the coated wires 6 are disposed in twisted manner. Reference numeral 10 denotes a sheath covering the above members. In such a construction, the number of twisted wires or coated wires is not specifically restricted, and a twisting manner of the primary wire and the coated wire is not specifically restricted. Diameter of the primary wire and the number of the primary wire also are not specifically restricted. The coating insulation member 4 may be omitted.

The inventors found that the conventional cable for use in robot which is subjected to the repeated bending comprises a thin wire made of copper alloy having large plastic strain to rupture of the wire in order to relax the stress caused by the repeated bending. However, the inventors are aware that the copper alloy having large plastic strain to rupture of the wire has lower mechanical strength and, when bending of the wire is repeated, plastic strain caused repeatedly are not completely relaxed by the plastic deformation but accumulated to cause fatigue failure of the wire, thereby lifetime of the wire and cable is limited.

As to metallic material, yield point is practically determined as a stress (proof stress) which cause 0.2% residual strain. If the stress is made greater than the yield point, it comes into plastic region in practice. The cable for use in robot is usually subjected to repeated bending which cause a strain of 1% or more in wire. In the conventional cable such as those manufactured by using the typical high durable copper alloy containing Sn, the wire thereof readily reaches the plastic region with the strain of the above-mentioned 1% or more and therefore, the plastic strain is accumulated.

Figure 2:
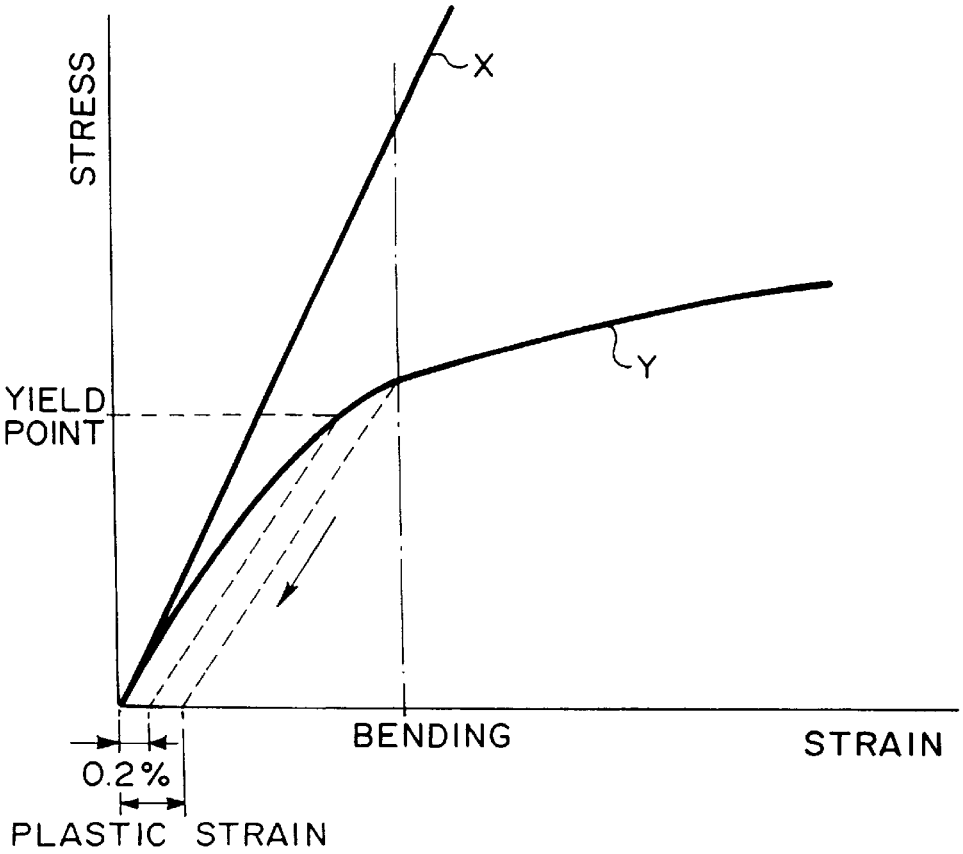
FIG. 2 is a graph showing stress-strain curves of conductors.

In the present invention, the wire is made of a conductor whose plastic strain to rupture is substantially less than 0.2%. It is preferable that the plastic strain to rupture of the conductor is substantially less than 0.1%, and particularly less than 0.0375%. Therefore, if the wire is repeatedly bent, the stress is practically in elastic region and therefore, the accumulation of the plastic strain do not occur as shown in FIG. 2, wherein X is a curve of the conductor of the wire used in the cable for use in robot according to the present invention and Y is a curve of the conventioal conductor of the wire used in the cable for use in robot.

The conductor whose plastic strain to rupture is substantially less than 0.2% is made of metallic fiber-reinforced copper matrix composite which is subjected to high degree of deformation. The process for the high degree of deformation in the present invention is that the conductor becomes to have the plastic strain to rupture of less than 0.2%. Such a process can be performed by processing the ingot of the conductor material into the primary wire via rolling with grooved roller, drawing or the like with the reduction in sectional area of 99.9% or more, preferably 99.99% or more, through the entire processing.

The metallic fiber-reinforced copper matrix composite is a composite having a copper matrix and metallic fibers contained within the copper matrix to reinforce the conductor material and, examples thereof are disclosed in Metallurgical Transactions, vol. 24A (1993). The composite material is characterized in that the high conductivity can be realized on the basis of electric current flowing in the copper matrix and the high mechanical strength can be realized by the reinforcing metallic fibers.

Among the metallic fiber-reinforced copper matrix composite, in-situ metallic fiber-reinforced copper matrix composite is preferable. Example thereof is a composite comprising copper and niobium. The in-situ metallic fiber-reinforced copper matrix composite is manufactured by casting a plurality of material components which are hardly dissolve to each other to obtain an ingot, and by performing hot process or cold process for drawing to obtain the primary wire. Detailed description of the in-situ metallic fiber-reinforced copper matrix composite is disclosed in J. Bevk et al., J. Appl. Phys., vol. 49 (1978) 6031.

In the following literatures, copper-silver in-situ fiber-reinforced composite material and copper-chromium in-situ fiber-reinforced composite material are disclosed.

Y. Sakai et al., Appl. Phys. Lett., vol. 59 (1991), 2965;

T. Takeuchi et al., J. Less-Common Metals, vol. 157 (1990), 25

The followings are examples of the in-situ metal fiber-reinforced copper matrix composite which can be used in the present invention:

Cu—Nb; Cu—Ag; Cu—Nb,Ag; Cu—Cr; Cu—Cr,Ag;

Cu—Cr,Zr(zirconium); Cu—W(tungsten); Cu—Ta (tantalum); and

Cu—Mo(molybdenum).

With use of these composites, a conductivity of greater than 70% IACS and a tensile strength of greater than 100 $Kg/mm^2$ can be obtained.

Figure 3:
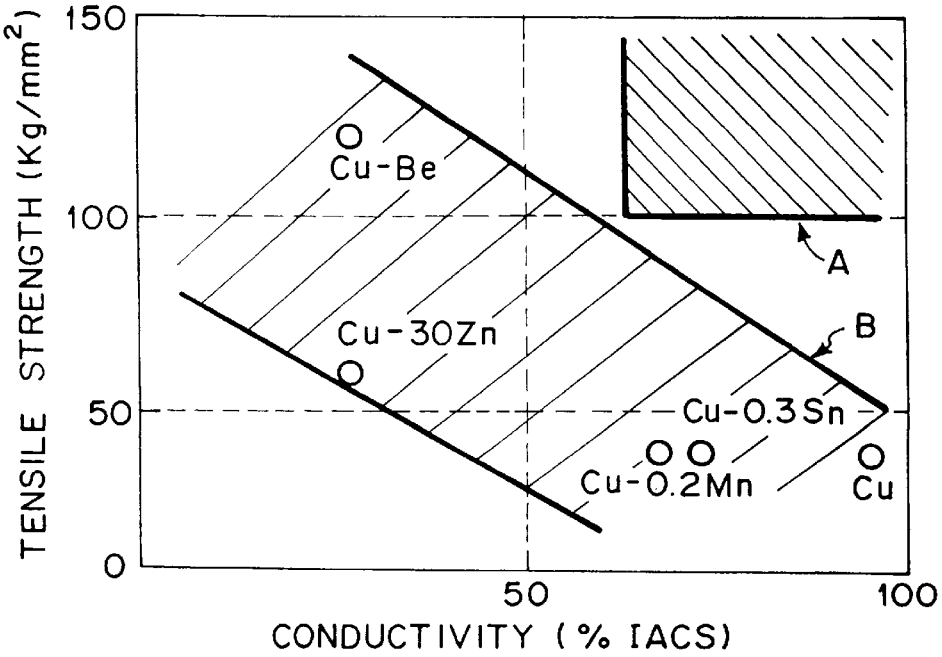
FIG. 3 is a graph showing conductivity and tensile strength of conductors.

In the present invention, it is preferable that the conductor has a conductivity of greater than 70% IACS and a tensile strength of greater than 100 $Kg/mm^2$ as shown in FIG. 3, wherein A is a preferable area of the conductor of the present invention and B is an area of the conventional conductor of wire for use in robot.

In the present invention, the conductor constituting the wire is characterized in that the deformation thereof is performed practically only in elastic region and the plastic strain is practically not accumulated and therefore, fatigue failure based on the accumulated strain do not occur in practice. Thus the lifetime of the wire and the cable is much longer than that of the conventional ones.

The lifetime of the wire or the cable is determined a number of cycles of the repeated bending with which the cable becomes in failure. Typical method for bending test is performed as shown in FIGS. 4A and 4B.

Figure 4A:
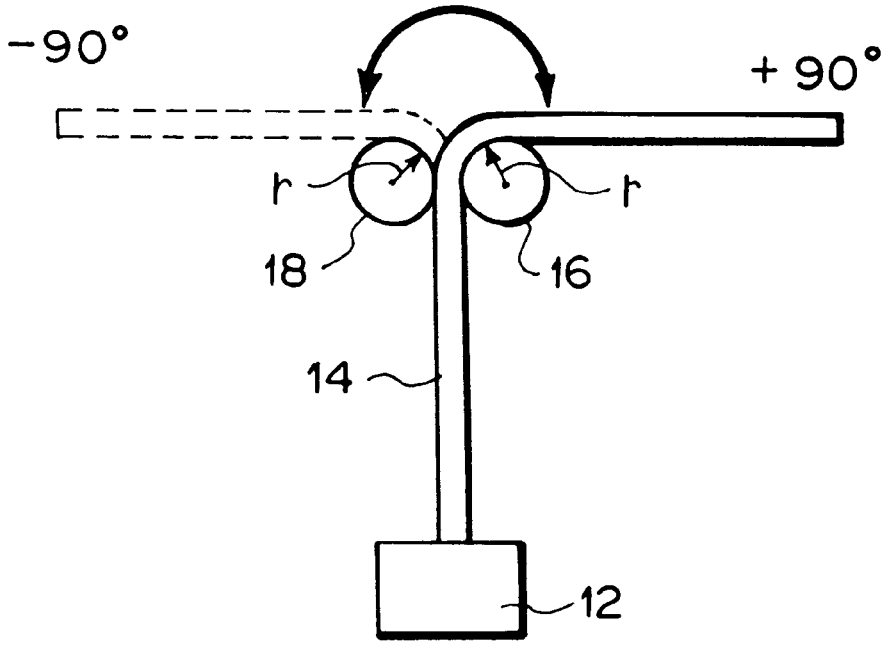
FIGS. 4A and 4B show repeated bending test methods.

In a method of FIG. 4A, a weight 12 is connected to the lower end of the cable 14. The cable 14 is passed through a pair of rollers 16, 18 each having a diameter of r. The upper portion of the cable 14 is repeatedly bent between a +90 degree position where the upper portion is in right-hand position relative to the pair of rollers 16, 18 and a −90 degree position where the upper portion is in left-hand position relative to the pair of rollers.

Figure 4B:
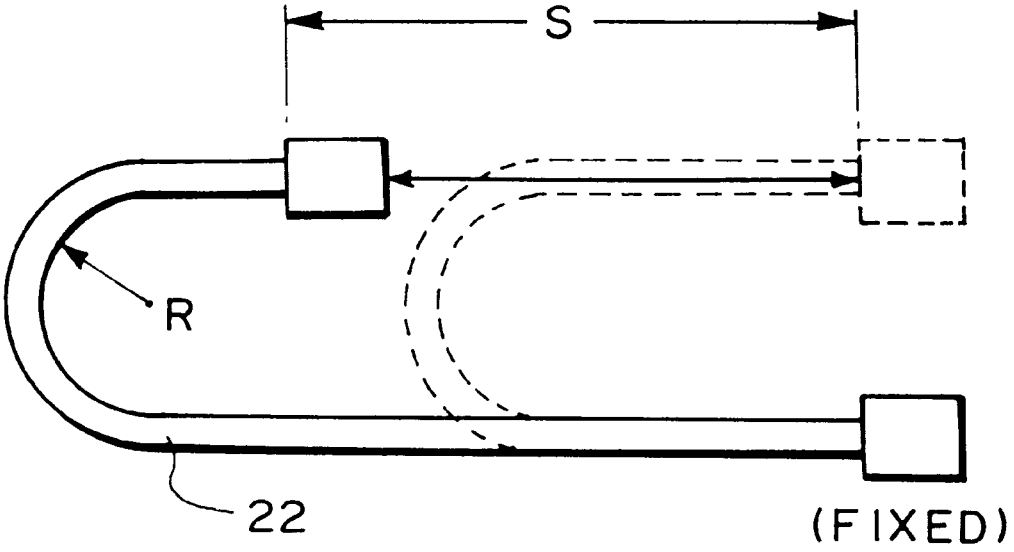

In another method of FIG. 4B, the cable 22 is bent with a radius of R and, one end of the cable 22 is fixedly hold and the other end is moved within a stroke of S horizontally in such a manner the portion other than a bent portion is hold horizontally.

The wire and cable according to the present invention show the significantly greater number of cycles of the repeated bending test shown in FIGS. 4A and 4B with which the cable becomes in failure, as compared with the conventional wire and cable.

EXAMPLE

Primary wires having a diameter of 0.08 mm were manufactured by drawing a conductor of copper alloy containing 24% of silver (Ag) and the copper (Cu) as residual with the reduction in cross sectional area of 99.995%. The plastic strain to rupture of the primary wire was substantially zero (not detected by the detector which can detect 0.02%), the conductivity of the primary wire detected by the four terminal method was 80% IACS, and the tensile strength of the primary wire was 130 $Kg/mm^2$. The conductor of the primary wire thus obtained was an in-situ fiber-reinforced Cu—Ag composite alloy.

20 Primary wires were gathered around an insulation core member made of aramid fiber of 200 deniers in such a manner that the wires were left hand twisted at a pitch of 5.5 mm. A sheath made of polyethylene having a thichness of 0.2 mm were formed by coating with extrusion.

The cable thus obtained were subjected to the repeated bending test as shown in FIG. 4A wherein bending radius r was 5 mm, weight 12 was of 100 g and time per cycle was set to be 30 cycles/minute. The lifetime of the cable thus measured was more than 1,400,000 cycles (the primary wire was not broken with 1,400,000 cycles of the repeated bending).

COMPARATIVE EXAMPLE

The cable was manufactured in an analogous manner to the above Example except that the conductor of the primary wire was Cu alloy containig 0.3% by weight of Sn.

The cable thus obtained was subjected to the repeated bending test in the same manner as the above Example. The lifetime of the cable was 78,000 cycles (the primary wire was broken with 78,000 cycles of the repeated bending).

What is claimed is:

1. A robot wire comprising at least one primary wire of conductor made of in-situ metallic fiber-reinforced copper matrix composite, said at least one primary wire of conductor being non-coiled spring type wire having a diameter equal to or less than 0.08 mm, said copper matrix composite being one of Cu—Ag composite, Cu—Cr composite or Cu—Ag,Cr composite, wherein said at least one primary wire of conductor acts as elastic material in repeated bending of the robot wire caused by robot operations and performed in such a manner that a first portion of the robot wire is repeatedly swung between a +90 degree position and a −90 degree position relative to a second portion of the robot wire.

2. A robot wire as claimed in claim 1, wherein said at least one primary wire of conductor shows a lifetime of more than 1,400,000 cycles in the repeated bending.

3. A robot wire as claimed in claim 1, wherein said at least one primary wire of conductor comprises a plurality of primary wires of conductor each being made of said in-situ metallic fiber-reinforced copper matrix composite, each of said plurality of primary wires of conductor being non-coiled spring type wire having a diameter equal to or less than 0.08 mm, wherein each of said plurality of primary wires of conductor acts as elastic material in repeated bending of the robot wire caused by robot operations and performed in such a manner that the first portion of the robot wire is repeatedly swung between the +90 degree position and the −90 degree position relative to the second portion of the robot wire.

4. A robot wire as claimed in claim 3, wherein an insulation member is coated on each of said plurality of primary wires of conductor to form a coated wire.

5. A robot cable comprising:

at least one robot wire comprising at least one primary wire of conductor made of in-situ metallic fiber-reinforced copper matrix composite, said at least one primary wire of conductor being non-coiled spring type wire having a diameter equal to or less than 0.08 mm, said copper matrix composite being one of Cu—Ag composite, Cu—Cr composite or Cu—Ag,Cr composite, wherein said at least one primary wire of conductor acts as elastic material in repeated bending of the at least one robot wire caused by robot operations and performed in such a manner that a first portion of the at least one robot wire is repeatedly swung between a +90 degree position and a −90 degree position relative to a second portion of the at least one robot wire; and a sheath covering said at least one robot wire.

6. A robot cable as claimed in claim 5, wherein said at least one primary wire of conductor shows a lifetime of more than 1,400,000 cycles in the repeated bending.

7. A robot cable as claimed in claim 5, wherein said at least one primary wire of conductor comprises a plurality of primary wires of conductor each being made of said in-situ metallic fiber-reinforced copper matrix composite, each of said plurality of primary wires of conductor being non-coiled spring type wire having a diameter equal to or less than 0.08 mm, wherein each of said plurality of primary wires of conductor acts as elastic material in repeated bending of the at least one robot wire caused by robot operations and performed in such a manner that the first portion of the at least one robot wire is repeatedly swung between the +90 degree position and the −90 degree position relative to the second portion of the at least one robot wire.

8. A robot cable as claimed in claim 7, wherein an insulation member is coated on each of said plurality of primary wires of conductor to form a coated wire.

* * * * *